US009805889B2

(12) United States Patent
He

(10) Patent No.: US 9,805,889 B2
(45) Date of Patent: Oct. 31, 2017

(54) BREAKER

(71) Applicant: Chengxiang He, Shanghai (CN)

(72) Inventor: Chengxiang He, Shanghai (CN)

( * ) Notice: Subject to any disclaimer, the term of this patent is extended or adjusted under 35 U.S.C. 154(b) by 0 days.

(21) Appl. No.: 14/846,790

(22) Filed: Sep. 6, 2015

(65) Prior Publication Data

US 2015/0380189 A1 Dec. 31, 2015

Related U.S. Application Data

(63) Continuation-in-part of application No. PCT/CN2013/072788, filed on Mar. 18, 2013.

(30) Foreign Application Priority Data

Mar. 7, 2013 (CN) ..... 2013 2 0105054 U

(51) Int. Cl.

| | |
|---|---|
| ***H01H 1/64*** | (2006.01) |
| ***H01H 1/66*** | (2006.01) |
| ***H01H 33/53*** | (2006.01) |
| ***H01H 71/08*** | (2006.01) |
| ***H01H 11/00*** | (2006.01) |
| ***H01H 71/10*** | (2006.01) |
| *H01H 71/02* | (2006.01) |

(52) U.S. Cl.

CPC ..... *H01H 33/53* (2013.01); *H01H 11/0031* (2013.01); *H01H 71/08* (2013.01); *H01H 71/1045* (2013.01); *H01H 71/0228* (2013.01); *H01H 2219/036* (2013.01)

(58) Field of Classification Search

CPC ..... H01H 33/53; H01H 71/1045; H01H 11/0031; H01H 71/08; H01H 2219/036; H01H 71/0228

See application file for complete search history.

(56) References Cited

U.S. PATENT DOCUMENTS

| | | | | |
|---|---|---|---|---|
| 4,611,201 A * | 9/1986 | Guim | ..... | H01H 71/46 200/310 |
| 6,703,917 B2 * | 3/2004 | Belenger | ..... | H01H 73/14 200/308 |
| 2012/0152705 A1 * | 6/2012 | Nakano | ..... | H01H 73/20 200/293 |

* cited by examiner

*Primary Examiner* — Renee Luebke
*Assistant Examiner* — Lheiren Mae A Caroc
(74) *Attorney, Agent, or Firm* — Wayne & Ken, LLC; Tony Hom

(57) ABSTRACT

A circuit breaker, comprising a housing (100), an input-side wiring terminal (111) and an output-side wiring terminal (112) which are positioned on the housing, and a moving contact (202) and a stationary contact (201) which are positioned in the housing. A passage (300) is arranged in the housing between two wiring terminals to be connected with a conductor (400), and the conductor connected with the two wiring terminals is arranged in the passage. Therefore, the present invention has the advantages of simple wire connection, good safety, space saving, beautiful appearance and clear and accurate indication of the switch state.

11 Claims, 14 Drawing Sheets

BREAKER

CROSS-REFERENCE TO RELATED APPLICATIONS

This application is a continuation-in-part of International Patent Application No. PCT/CN2013/072788 with an international filing date of Mar. 18, 2013, designating the United States, and further claims priority benefits to Chinese Patent Application No. 201320105054.5 filed Mar. 7, 2013. The contents of all of the aforementioned applications, including any intervening amendments thereto, are incorporated herein by reference.

TECHNICAL FIELD

The present invention belongs to the technical field of circuit breakers, in particular to a circuit breaker capable of performing open arc extinguishment.

BACKGROUND

It is well-known that because a DC circuit breaker, unlike an AC circuit breaker, does not have a null-point arc extinguishing function and it is difficult to open the short circuit direct current (even small multiples of fault current) and extinguish an electric arc, it is much more difficult for the DC circuit breaker to perform open arc extinguishment than the AC circuit breaker. The current solution is generally to increase the distance between a moving contact and a stationary contact. Two electrodes in a three-electrode or four-electrode AC circuit breaker are often connected in series to form a two-electrode DC circuit breaker, wherein one or two electrodes are two open ports. The distance between the moving contact and the stationary contact is increased in such a manner of serial connection of the open ports so that each open port carries a part of electric arc energy, thereby achieving the purpose of arc extinguishment (extinction). The current common connection modes are shown in FIG. 1, FIG. 2 and FIG. 3.

FIG. 1 belongs to a three-electrode circuit breaker which adopts a cable or a cope busbar 400 for external wire connection to form a DC circuit breaker, and the wire connection mode is that switches are connected in series from top to bottom (between an input end and an output end). Although the current directions are consistent, the wire connection is complicated and the external wire connection of input incoming wires and the cable generates mutual intersection. It is not safe and not convenient for installation.

FIG. 2 belongs to a four-electrode circuit breaker which adopts a cable or a copper busbar 400 for external wire connection to form a DC circuit breaker. The exposed copper busbar 400 is not safe, and insulating and protecting measures are required to be increased. The wire connection mode is that the lower switches (between output ends) are connected in series and the upper switches (between input ends) are connected in series. Meanwhile, the current directions are not consistent.

FIG. 3 is a four-electrode circuit breaker which adopts a cable or a copper busbar 400 for external wire connection to form a DC circuit breaker. The wire connection mode is that switches are connected in series from top to bottom. Although the current directions are consistent, the wire connection is complicated and the external wire connection of input incoming wires and the cable generates mutual intersection. It is not safe and not convenient for installation.

Each of the above circuit breakers becomes a DC circuit breaker in the mode, of externally connecting the cable or the copper busbar or the conducting wire in series, having the following defects:

1 The wire connection is complicated and insulating and protecting measures are required to be increased.

2. The copper busbar or the conducting wire comes into contact with the outside, and the safety is poor.

3. The DC circuit breaker is not beautiful and more installation space is needed.

4. The switch state of the circuit breaker cannot be clearly indicated.

SUMMARY OF THE PRESENT INVENTION

A technical problem to be solved by the present invention is to provide a circuit breaker with simple wire connection, good safety, space saving and beautiful appearance and with an arc extinguishing function so as to overcome the defects existing in the prior art.

To solve the above technical problem, the present invention adopts the following technical solutions:

A circuit breaker, comprising a housing, an input-side wiring terminal and an output-side wiring terminal which are positioned on the housing, and a moving contact and a stationary contact which are positioned in the housing. The circuit breaker is characterized in that a passage is arranged in the housing between two wiring terminals to be connected with a conductor, and the conductor connected with the two wiring terminals is arranged in the passage.

In a preferred embodiment of the present invention, the passage is formed by forming a groove on the back of the housing and covering with an insulating plate, and the conductor is positioned in the groove. The structure is convenient for processing and assembly.

In a specific embodiment, the conductor is a copper busbar.

In a specific embodiment, a perforated copper column is connected to the wiring terminals and the ends of the copper busbar.

In one embodiment of the present invention, the circuit breaker is a three-electrode AC-DC circuit breaker; a passage is arranged between a third-electrode wiring terminal on an input side and a second-electrode wiring terminal on an output side (or between a first wiring terminal on the input side and a second wiring terminal on the output side) in the housing; the copper busbar is positioned in the passage; and both ends of the copper busbar are respectively connected with the wiring terminals corresponding to the copper busbar.

In another embodiment of the present invention, the circuit breaker is a four-electrode AC-DC circuit breaker; passages are arranged between a second-electrode wiring terminal on an input side and a first-electrode wiring terminal on an output side (or between a first-electrode wiring terminal on the input side and a second-electrode wiring terminal on the output side) and between a third-electrode wiring terminal on the input side and a fourth-electrode wiring terminal on the output side (or between a fourth-electrode wiring terminal on the input side and a third-electrode wiring terminal on the output side) in the housing; and two copper busbars are respectively positioned in the two passages and respectively connected with the wiring terminals corresponding to the copper busbars.

To ensure that the switch state of the circuit breaker can be clearly and accurately indicated, indicating lamps are arranged in the housing, and the indicating lamps are connected with current limiting resistors in series and arranged in a circuit on the output side. The housing has a window on a panel in a position corresponding to the indicating lamps.

For a DC circuit breaker, the indicating lamps and the current limiting resistors are connected in series between a positive electrode and a negative electrode on the output side of the circuit breaker. After a switch is closed, the indicating lamps emit light, indicating that the DC circuit breaker is switched on.

For an AC circuit breaker, the indicating lamps and the current limiting resistors are connected in series between electrodes (phases) on the output side for indicating whether there is a lack in A phase, B phase and C phase of the AC circuit breaker. When the switch is closed, all of the indicating lamps emit light; and when a certain phase is de-energized, the indicating lamp of the phase goes out for prompting that a power supply of a certain phase fails, i.e., lacks of a phase.

The indicating lamps are neon lamps or LED lamps.

In the present invention, the passages are arranged in the housing of the circuit breaker and the wiring terminals are connected in series with the copper busbar in the passages, thereby ensuring consistent direction of the current and normative and simple wire connection, avoiding electric shock hazard, not contacting the outside and ensuring the safety. Meanwhile, a switch state indicating device is configured on the panel, and can be used for indicating the on/off state of the switch.

Therefore, the present invention has the advantages of simple wire connection, good safety, space saving, beautiful appearance and clear and accurate indication of the switch state.

BRIEF DESCRIPTION OF THE DRAWINGS

The present invention is described below in detail n combination with the drawings and specific embodiments.

DETAILED DESCRIPTION OF THE EMBODIMENTS

The circuit breaker of the present invention comprises a housing, an input-side wiring terminal and an output-side wiring terminal which are positioned on the housing, and a moving contact and a stationary contact which are positioned in the housing. A passage is arranged in the housing between two wiring terminals to be connected with a conductor, and the conductor connected with the two wiring terminals is arranged in the passage. Passages are arranged in the housing of the circuit breaker and the wiring terminals are connected in series with the copper busbar in the passages, thereby ensuring consistent direction of the current and normative and simple wire connection, avoiding electric shock hazard, not contacting the outside and ensuring the safety.

To facilitate processing and assembly, each passage is formed by forming a groove on the back of the housing and covering with an insulating plate, and the conductor is positioned in the groove.

To clearly describe the technical solutions and the features of the present invention, the present invention will be described below in detail through the embodiments:

Embodiment 1

Figure 1:
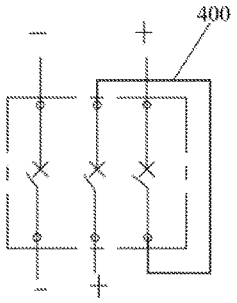
FIG. 1 is a circuit diagram of external wire connection of a three-electrode circuit breaker.
Figure 2:
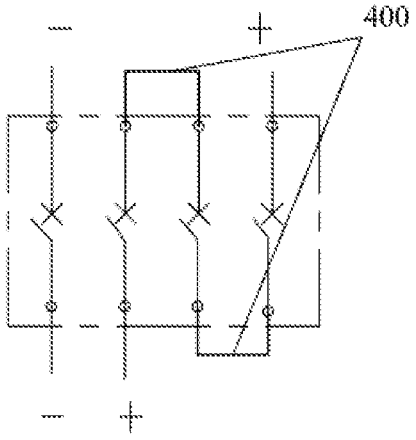
FIG. 2 is a diagram of lode of external wire connection of a four-electrode circuit breaker.
Figure 3:
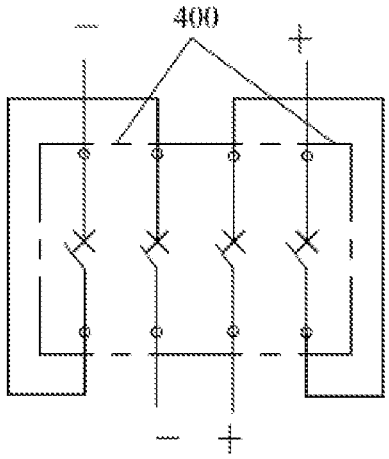
FIG. 3 is a diagram of a second mode of external wire connection of a four-electrode circuit breaker.
Figure 4:
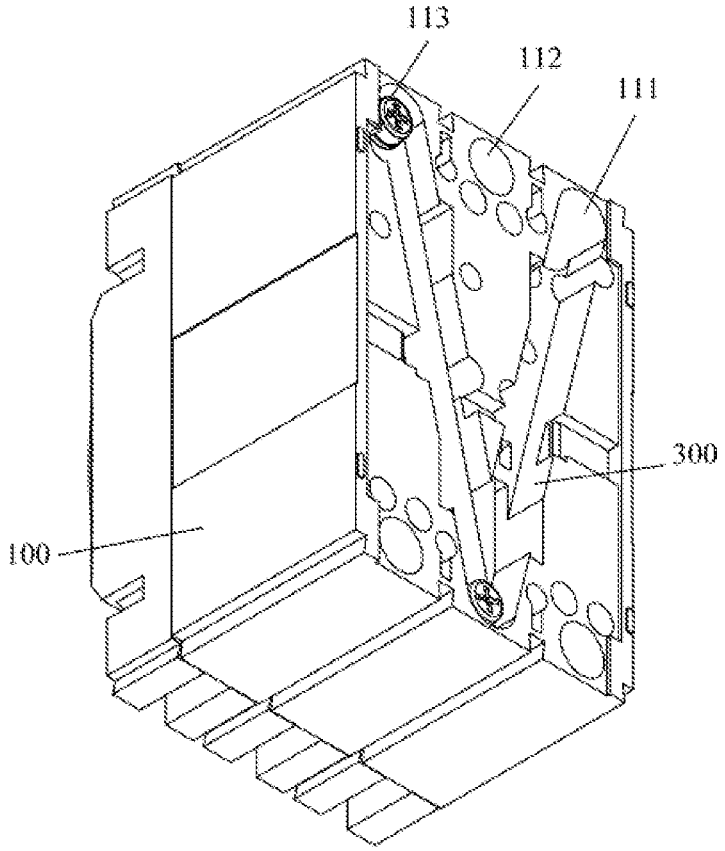
FIG. 4 is a stereographic diagram of a three-electrode AC-DC circuit breaker of embodiment 1.
Figure 5:
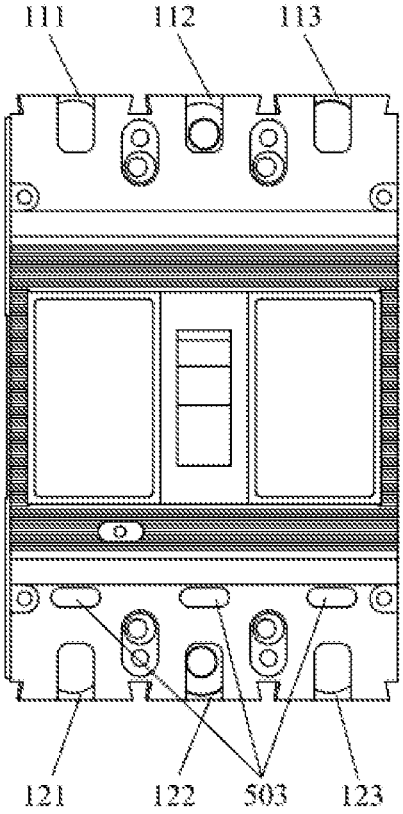
FIG. 5 is a front diagram of a three-electrode AC-DC circuit breaker of embodiment 1.
Figure 6:
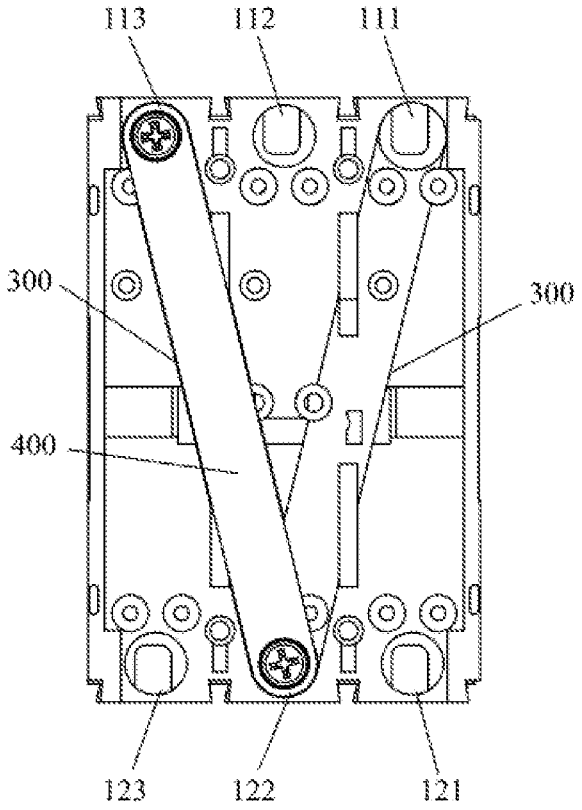
FIG. 6 is a back diagram of a three-electrode AC-DC circuit breaker of embodiment 1.
Figure 7:
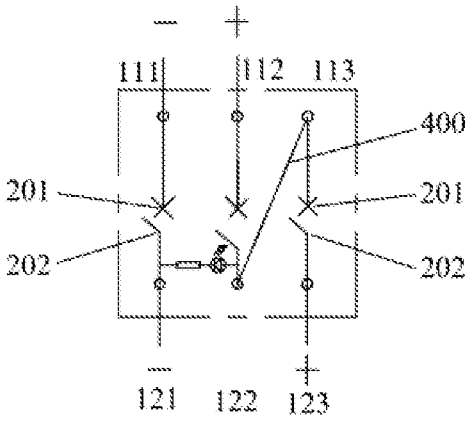
FIG. 7 is a circuit diagram of internal wire connection of a DC circuit breaker of embodiment 1.

As shown in FIG. 4 to FIG. 6, a three-electrode AC-DC circuit breaker comprises a housing 100, wherein a first-electrode wiring terminal 111, a second-electrode wiring terminal 112 and a third-electrode wiring terminal 113 on an input side are arranged on the upper part of the housing 100; a first-electrode wiring terminal 121, a second-electrode wiring terminal 122 and a third-electrode wiring terminal 123 on an output side are arranged on the lower part of the housing 100; and a stationary contact 201 and a moving contact 202 are arranged in the housing 100 (as shown in FIG. 7).

As shown in FIG. 4 to FIG. 6, a groove 300 is arranged between a third-electrode wiring terminal 113 on the input side and a second-electrode wiring terminal 122 on the output side on the back of the housing 100. A copper busbar 400 is arranged in the groove 300. Both ends of the copper busbar 400 are respectively connected with the input-side wiring terminal 113 and the output-side wiring terminal 122.

Figure 14:
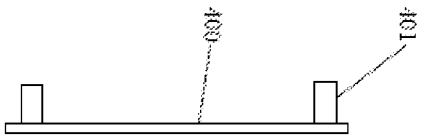
FIG. 14 is a structural diagram of connection of a copper busbar.

Specifically, in combination with FIG. 14, both ends of the copper busbar 400 are respectively fixed to the wiring terminal 113 and the wiring terminal 122 together with the perforated copper column 401. The copper busbar 400 is inlaid in the groove 300 on the back of the housing 100. An epoxy insulating plate (not shown in the figure) is covered on the back of the housing 100 for performing protection and isolation. Series wire connection in the circuit breaker is safe and beautiful. The internal wire connection diagram is shown in FIG. 7.

As shown in FIG. 7, in order to indicate the switch state of the DC circuit breaker, the DC circuit breaker also comprises a state indicating device. In combination with FIG. 7, the state indicating device comprises indicating lamps 501 and current limiting resistors 502 connected in series, and is connected between a positive electrode and a negative electrode on the output side of the circuit breaker (i.e., a second electrode and a first electrode on the output side) for indicating the on/off of a DC switch. The indicating lamps 501 can be neon lamps or LED lamps.

Figure 8:
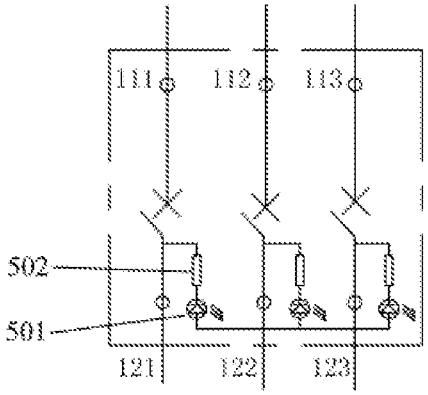
FIG. 8 is a circuit diagram of internal wire connection of an AC circuit breaker of embodiment 1.

As shown in FIG. 8, for an AC circuit breaker, the indicating lamps 501 and the current limiting resistors 502 of the state indicating device can also be arranged between two electrodes of the circuit on the output side (i.e., between the first electrode and the second electrode, between the second electrode and a third electrode and between the third electrode and the first electrode on the output side) for indicating the on/off of an AC switch.

Also as shown in FIG. 5, a window 503 for the emission of the indicating lamps is arranged on a panel of the housing 100 in a position corresponding to the indicating lamps. After the circuit breaker is closed, the light emitted through the window 503 can indicate that the circuit is switched on.

Embodiment 2

Figure 9:
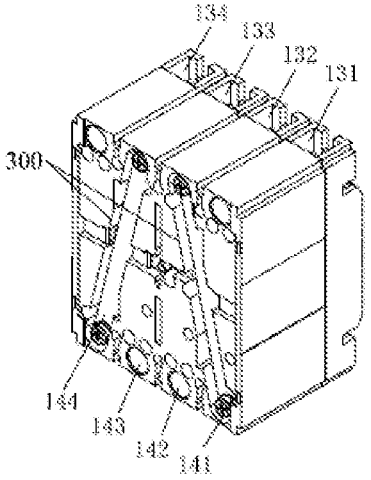
FIG. 9 is a stereographic diagram of a four-electrode AC-DC circuit breaker of embodiment 2.
Figure 10:
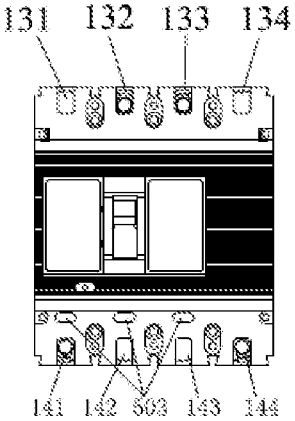
FIG. 10 is a front diagram of a four-electrode AC-DC circuit breaker of embodiment 2.
Figure 11:
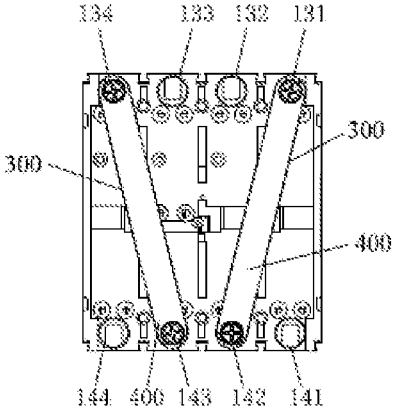
FIG. 11 is a back diagram of a four-electrode AC-DC circuit breaker of embodiment 2.

As shown in FIG. 9 to FIG. 11, a four-electrode AC-DC circuit breaker and the difference with embodiment 1 that the input side and the output side of the circuit breaker respectively have several electrodes, namely that a first-electrode wiring terminal 131, a second-electrode wiring terminal 132, a third-electrode wiring terminal 133 and a fourth-electrode wiring terminal 134 on an input side are respectively arranged on the upper part of the housing 100, and a first-electrode wiring terminal 141, a second-electrode wiring terminal 142, a third-electrode wiring terminal 143 and a fourth-electrode wiring terminal 144 on the output side are respectively arranged on the lower part of the housing 100.

As shown in FIG. 9 and FIG. 11, grooves 300 are respectively arranged between the input-side wiring terminal 134 and the output-side wiring terminal 143 and between the input-side wiring terminal 131 and the output-side wiring terminal 142 on the back of the housing 100. Two copper busbars 400 are respectively inlaid in the two grooves 300. Both ends of the first copper busbar 400 are respectively connected with the input-side wiring terminal 131 and the output-side wiring terminal 142, and both ends of the second copper busbar 400 are respectively connected with the input-side wiring terminal 134 and the output-side wiring terminal 142. The internal wire connection diagram is shown in FIG. 12.

Figure 12:
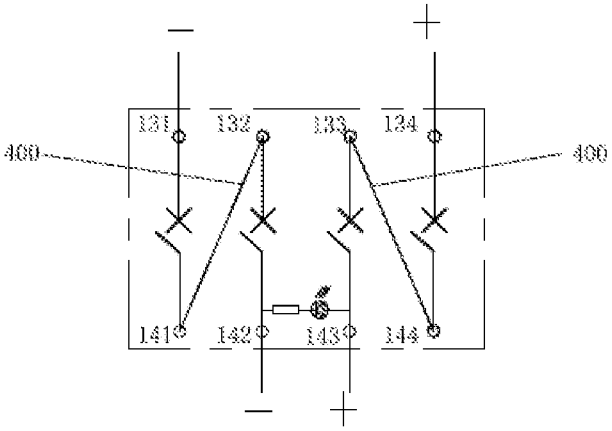
FIG. 12 is a circuit diagram of internal wire connection of a DC circuit breaker of embodiment 2.

As shown in FIG. 12, the indicating lamps 501 and the current limiting resistors 502 connected in series are connected between a positive electrode and a negative electrode on the output side of the circuit breaker (i.e., between a third electrode and a second electrode on the output side). The on/off of the DC switch is indicated.

Figure 13:
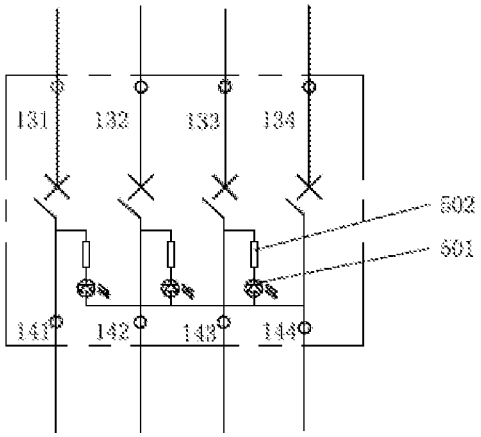
FIG. 13 is a circuit diagram of internal re connection of an AC circuit breaker of embodiment 2.

As shown in FIG. 13, the indicating lamps 501 and the current limiting resistors 502 of the state indicating device can also be arranged between a phase line and a null line of each item of an output-side circuit (i.e., between the first electrode and the second electrode, between the second electrode and the third electrode and between the third electrode and the first electrode on the output side) for indicating the on/off of an AC switch.

Other structures and embodiments are identical, and will not be described again.

However, those skilled in the art should appreciate that the above embodiments are only used for describing the present invention, rather than limiting the present invention. Modifications and variations to the above embodiments will be covered within the claims of the present invention without departing from the substantial spirit of the present invention.

I claim:

1. A circuit breaker, comprising a housing, an input-side wiring terminal and an output-side wiring terminal which are positioned on the housing, and a moving contact and a stationary contact which are positioned in the housing; and the circuit breaker is characterized in that a passage is arranged in said housing between two wiring terminals to be connected with a conductor, and the conductor connected with two wiring terminals is arranged in said passage; and wherein said passage is formed by forming a groove on the hack of the housing and covering with an insulating plate, and said conductor is positioned in said groove.

2. The circuit breaker according to claim 1, characterized in that: said conductor is a copper busbar.

3. The circuit breaker according to claim 2, characterized in that: said wiring terminals are connected with a perforated copper column and the copper busbar.

4. The circuit breaker according to claim 2, characterized in that: said circuit, breaker is a three-electrode AC-DC circuit breaker; a passage is arranged between a third-electrode wiring terminal on an input side and a second-electrode wiring terminal on an output side (or between a first-electrode wiring terminal on the input side and a second-electrode wiring terminal on the output side) in the housing; said copper busbar is positioned in said passage; and both ends of said copper busbar are respectively connected with the wiring terminals corresponding to said copper busbar.

5. The circuit breaker according claim 2, characterized in that: said circuit breaker is a four-electrode AC-DC circuit breaker; passages are arranged between a second-electrode wiring terminal on an input side and a first-electrode wiring terminal on an output side (or between a first-electrode wiring terminal on the input side and a second-electrode wiring terminal on the output side) and between a third-electrode wiring terminal on the input side and a fourth-electrode wiring terminal on the output side (or between a fourth-electrode wiring terminal the input side and a third-electrode wiring terminal on the output side) in said housing; and two copper busbars are positioned in two passages and respectively connected with the wiring terminals corresponding to the copper busbars.

6. The circuit breaker according to claim 1, characterized in that: indicating lamps are arranged in said housing; said indicating lamps are connected with current limiting resistors at series and connected in a circuit on the output side of the circuit breaker; and said housing has a window on a panel in a position corresponding to said indicating lamps.

7. The circuit breaker according to claim 6, characterized in that: said circuit breaker is a DC circuit breaker, and said indicating lamps are connected with the current limiting resistors in series and connected between a positive electrode and a negative electrode on the output side of the circuit breaker.

8. The circuit breaker according to any claim of claim 7, characterized in that said indicating lamps are neon, lamps or LED lamps.

9. The circuit breaker according to claim 6, characterized in that: said circuit breaker is an AC circuit breaker, and said indicating lamps and said current limiting resistors are connected in series between electrodes on the output side of the circuit breaker.

10. The circuit breaker according to any claim of claim 9, characterized in that: said indicating lamps are neon lamps or LED lamps.

11. The circuit breaker according to any claim of claim 6, characterized in that: said indicating lamps are neon lamps or LED lamps.

* * * * *